US009752794B2

(12) United States Patent
Perin

(10) Patent No.: US 9,752,794 B2
(45) Date of Patent: Sep. 5, 2017

(54) CURVILINEAR SOUND ABSORBER

(71) Applicant: 3M INNOVATIVE PROPERTIES COMPANY, St. Paul, MN (US)

(72) Inventor: Dino Perin, Carmel, IN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/034,999

(22) PCT Filed: Dec. 17, 2014

(86) PCT No.: PCT/US2014/070774

§ 371 (c)(1),
(2) Date: May 6, 2016

(87) PCT Pub. No.: WO2015/100094

PCT Pub. Date: Jul. 2, 2015

(65) Prior Publication Data

US 2016/0282007 A1 Sep. 29, 2016

Related U.S. Application Data

(60) Provisional application No. 61/920,124, filed on Dec. 23, 2013.

(51) Int. Cl.
*F24F 13/24* (2006.01)
*F24F 13/02* (2006.01)

(52) U.S. Cl.
CPC ..... *F24F 13/0263* (2013.01); *F24F 13/24* (2013.01); *F24F 2013/242* (2013.01)

(58) Field of Classification Search
CPC ... F24F 13/0263; F24F 13/24; F24F 1203/242
USPC ..... 181/224, 264
See application file for complete search history.

(56) References Cited

U.S. PATENT DOCUMENTS 1,938,801 A * 12/1933 Bourne ..... F24F 1/02 165/122
6,342,005 B1 * 1/2002 Daniels ..... F24F 13/24 181/224
7,243,757 B2 * 7/2007 Stuber ..... F01N 1/02 181/249
8,061,476 B2 * 11/2011 Corin ..... F01N 1/083 181/224

(Continued)

FOREIGN PATENT DOCUMENTS

DE 42 32 315 3/1994
EP 1 378 669 1/2004

(Continued)

*Primary Examiner* — Forrest M Phillips
(74) *Attorney, Agent, or Firm* — Philip P. Soo; Philip Y. Dahl

(57) ABSTRACT

Baffle assemblies capable of reducing noise transmission while admitting airflow are provided, for use in air passages such as an inlet or exit of a duct, housing, enclosure or partition. The baffle assemblies comprise S-shaped baffle sections comprising two curved baffle units arranged so as to provide an S-shaped passage. In some embodiments the curved baffle units include a curved portion and at least one flange portion. In some embodiments the curved baffle units have a shape capable of manufacture by a continuous extrusion process.

15 Claims, 4 Drawing Sheets

(56) References Cited

U.S. PATENT DOCUMENTS

| | | | | |
|---|---|---|---|---|
| 8,104,572 | B2 * | 1/2012 | Butler | F01N 1/08 181/264 |
| 8,701,821 | B2 * | 4/2014 | O'Coimin | H05K 7/20736 181/224 |
| 2008/0230305 | A1 * | 9/2008 | Goto | G06F 1/182 181/224 |
| 2009/0283358 | A1 * | 11/2009 | Hughey | F01N 1/08 181/264 |
| 2010/0078258 | A1 * | 4/2010 | Tanabe | G10K 11/172 181/224 |

FOREIGN PATENT DOCUMENTS

| | | |
|---|---|---|
| GB | 1 557 534 | 12/1979 |
| WO | WO 2004/113660 | 12/2004 |

* cited by examiner

CURVILINEAR SOUND ABSORBER

CROSS REFERENCE TO RELATED APPLICATIONS

This application is a national stage filing under 35 U.S.C. 371 of PCT/US2014/070774, filed Dec. 17, 2014, which claims priority to U.S. Provisional Patent Application No. 61/920,124, filed Dec. 23, 2013, the disclosures of which are incorporated by reference in their entirety herein.

FIELD OF THE DISCLOSURE

This disclosure relates to baffles capable of reducing noise transmission while admitting airflow, for use in air passages such as an inlet or exit of a duct, housing, enclosure or partition.

SUMMARY OF THE DISCLOSURE

Briefly, the present disclosure provides a baffle assembly, such as for use in an inlet or exit of a duct, housing, enclosure or partition, comprising an S-shaped baffle section comprising two curved baffle units arranged so as to provide an S-shaped passage. Typically the baffle assembly comprises at least two S-shaped baffle sections each comprising two curved baffle units arranged so as to provide an S-shaped passage. In some embodiments, at least two S-shaped baffle sections are arranged front-to-back in an "SS" configuration, in some, at least two S-shaped baffle sections are arranged front-to-front in "SZ" configuration, and in some, at least two S-shaped baffle sections are arranged back-to-back in "ZS" configuration. In some embodiments, the curved baffle units bear an acoustically absorbing material, e.g., an acoustically absorbing non-woven material or an acoustically absorbing foam material. Typically the curved baffle units bear an acoustically absorbing material on their concave face, and in some embodiments the curved baffle units bear an acoustically absorbing material on their concave face only. In some embodiments the curved baffle units include a curved portion and at least one flange portion. In various embodiments, the curved portion may have a cross-section that is semi-circular, nearly semi-circular, parabolic, nearly parabolic, hyperbolic, or nearly hyperbolic. In some embodiments, the curved baffle units have a shape capable of manufacture by a continuous extrusion process.

DESCRIPTION

Figure 1:
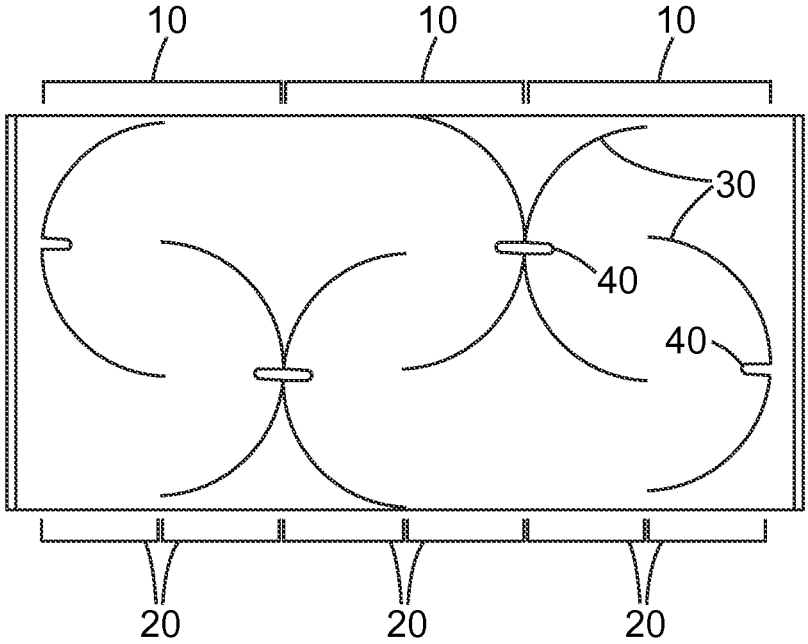
FIG. 1 is a schematic cross-section of exemplary Baffle Assembly A according to the present disclosure, as described in the Examples herein.
Figure 2:
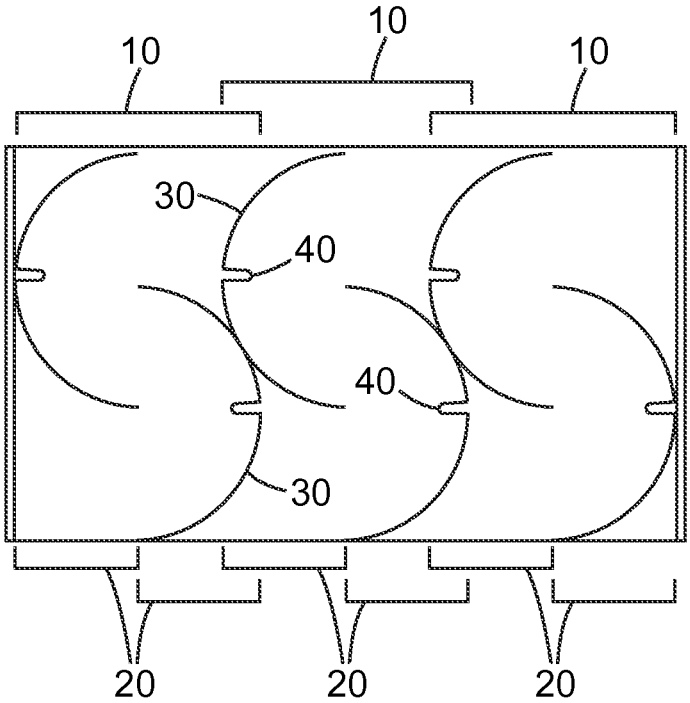
FIG. 2 is a schematic cross-section of exemplary Baffle Assembly B according to the present disclosure, as described in the Examples herein.

The present disclosure provides a sound absorbing apparatus for use in air inlet and outlets found in equipment such as generators sets, air compressors, HVAC ducting or housing/enclosures where air is moved in and out of inlets and exits and where reduction of noise level is required. The apparatus is a modular design consisting of the basic element, a "S" curved baffles supporting sound absorption material, that is stackable to accommodate any size of air inlet and outlets. The devise is scalable both in size and noise attenuation and accommodates many types of acoustic absorbing material to tune for precise sound attenuation. In some embodiments (such as depicted in FIGS. 1 and 2), the "S" curved baffles (50) are arranged front-to-back in "SS" configurations (see, e.g., the "SSS" configuration of FIG. 2.). In some embodiments, the "S" curved baffles (10) are arranged front-to-front or back-to-back in "SZ" or "ZS" configurations (see, e.g., the "SZS" configuration of FIG. 1.). In some embodiments, "SS" and "SZ" configurations are combined.

Typically each S-shaped baffle section comprises two curved baffle units. The curved baffle units include at least one curved portion. In some embodiments (such as depicted in FIGS. 1 and 2) the curved baffle units (20) include a curved portion (30) and at least one flange portion (40). In some embodiments (such as depicted in FIGS. 1 and 2) a single flange portion (40) bisects the curved portion (30). In some embodiments the curved portions are semi-circular in cross-section. In some embodiments the curved portions are nearly semi-circular in cross-section, departing from true circularity by no more than 10% over at least 80% of their curved portion. In some embodiments the curved portions are parabolic in cross-section. In some embodiments the curved portions are nearly parabolic in cross-section, departing from a true parabola by no more than 10% over at least 80% of their curved portion. In some embodiments the curved portions are hyperbolic in cross-section. In some embodiments the curved portions are nearly hyperbolic in cross-section, departing from a true hyperbola by no more than 10% over at least 80% of their curved portion. Baffles may be constructed of any suitable material, including metal, composite, polymer or ceramic materials or natural materials such as wood. In some embodiments baffles are made by a continuous extrusion process. In some embodiments baffles are made by a vacuum forming process. Baffles may be bare or may be covered with any suitable sound-absorbing or acoustic insulating material.

Objects and advantages of this disclosure are further illustrated by the following examples, but the particular materials and amounts thereof recited in these examples, as well as other conditions and details, should not be construed to unduly limit this disclosure.

EXAMPLES

The following abbreviations are used to describe the examples:

dB: decibel
ft: foot
Hz: Hertz
mm: meter
mil: $10^{-3}$ inches
mm: millimeter
μm: micrometer
SPL: sound pressure level
Acoustic Materials.

H-100PSM: A 1 mil (25.4 μm) aluminized polyester film faced 1-inch (25.4 mm) acoustical foam, obtained under the trade designation "TUFCOTE H-100PSM" from Aearo Technologies, LLC, Indianapolis, Ind.

TC2303: A 1.06-inch (26.9 mm) nonwoven acoustic insulating material, obtained under the trade designation "THINSULATE ACOUSTIC INSULATION TC2303" from 3M Company.

MA-4700: A 1-inch (25.4 mm) nonwoven hydrophobic microfiber acoustical insulation mat, obtained under the trade designation "THINSULATE MARINE INSULATION MA4700" from 3M Company.

The following baffle assemblies were constructed as follows:

Baffle Assembly A

A length of extruded semi-circular, 5 inch (127 mm) radius, 150 mil (3.81 mm), acrylonitrile butadiene styrene (ABS) extruded plastic, was cut into six, 24 inch (609.6 mm) elongate baffles. Bifurcating the concave face of each baffle was a flange, extending outward approximately 1-inch (25.4 mm) Baffles 1-6 were then cemented, by means of an adhesive acrylic foam tape, within a 24.5 by 32.0 by 15.5 inch (622.3 by 812.8 by 393.7 mm) plywood frame according to the following orientation: Baffles 1 and 2 were positioned centrally within the frame, with the collinearly opposed concave faces offset by 2.5 inches (63.5 mm) Baffles 3 and 4 were cemented, convex face to convex face opposite their respective flange, to Baffles 1 and 2, respectively. Baffles 5 and 6 were positioned with the concave face collinearly opposed, and offset by 2.5 inches (63.5 mm), to the concave face of Baffles 3 and 4, respectively. A plan view of the resulting baffle orientation is shown in FIG. 1.

Baffle Assembly B

A baffle assembly was constructed according to the procedure generally described in Baffle Assembly A, according to the following orientation: Baffles 1 and 2 were cemented centrally within the frame, with the collinearly opposed concave faces offset by 2.5 inches (63.5 mm) Baffles 3 and 4 were positioned diagonally opposite and then cemented, convex face to convex face and offset by 2.5 inches (63.5 mm), to Baffles 1 and 2, respectively. Baffles 5 and 6 were positioned with the concave face collinearly opposed, and offset by 2.5 inches (63.5 mm), to the concave face of Baffles 3 and 4, respectively. A plan view of the resulting baffle orientation is shown in FIG. 2.

Comparative Baffle Assemblies C1, C2 and C3

Figure 3A:
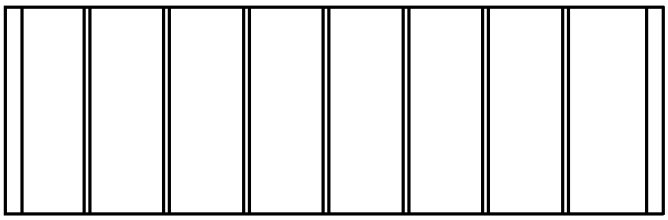
FIGS. 3*a*, 3*b* and 3*c* are schematic cross-sections of comparative baffle assemblies, as described in the Examples herein.
Figure 3B:
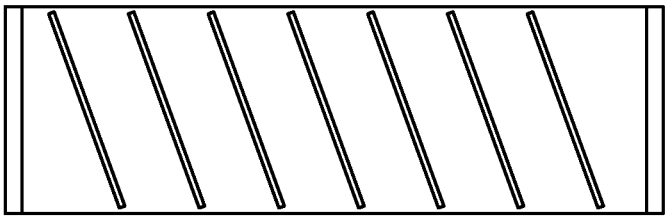
Figure 3C:
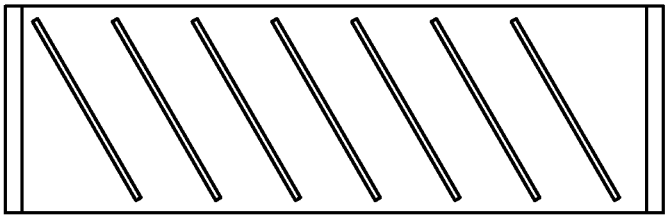

Plan views of Baffle Assemblies C1-C3 are illustrated in FIGS. 3*a*-3*c*, respectively.

Baffle Assembly C1

A baffle assembly was constructed according to the procedure generally described in Baffle Assembly A, wherein the six concave baffles were replaced with seven 24.5 by 10.0 inch by 150 mil (609.6 by 254.0 by 3.81 mm) plywood panels. The panels were cemented equidistantly within, and orientated parallel to, the sides of the frame.

Baffle Assembly C2

A baffle assembly was constructed according to the general procedure described in C1, wherein the plywood panels were orientated at an angle of 20 degrees relative to those in C1.

Baffle Assembly C3

A baffle assembly was constructed according to the general procedure described in C1, wherein the plywood panels were orientated at an angle of 30 degrees relative to those in C1.

Examples and Comparatives

The baffle assemblies were subsequently covered with the acoustic materials described above by means of an adhesive acrylic foam tape, With respect to Baffle Assemblies A and B, the acoustic material was cemented to the concave face of the baffles, while for Comparative Baffle Assemblies C1-C3 the acoustic material cemented to both sides of the plywood panels.

TABLE 1

| Sample | Baffle Assembly | Acoustic Material |
|---|---|---|
| Example 1 | A | None |
| Example 2 | B | None |
| Example 3 | A | H-100PSM |
| Example 4 | B | H-100PSM |
| Example 5 | A | TC2303 |
| Example 6 | B | TC2303 |
| Example 7 | A | MA-4700 |
| Example 8 | B | MA-4700 |
| Comparative A | C1 | None |
| Comparative B | C2 | None |
| Comparative C | C3 | None |
| Comparative D | C1 | H-100PSM |
| Comparative E | C2 | H-100PSM |
| Comparative F | C3 | H-100PSM |
| Comparative G | C1 | TC2303 |
| Comparative H | C2 | TC2303 |
| Comparative I | C3 | TC2303 |
| Comparative J | C1 | MA-4700 |
| Comparative K | C2 | MA-4700 |
| Comparative L | C3 | MA-4700 |

Test Methods

Sound Attenuation

Figure 4:
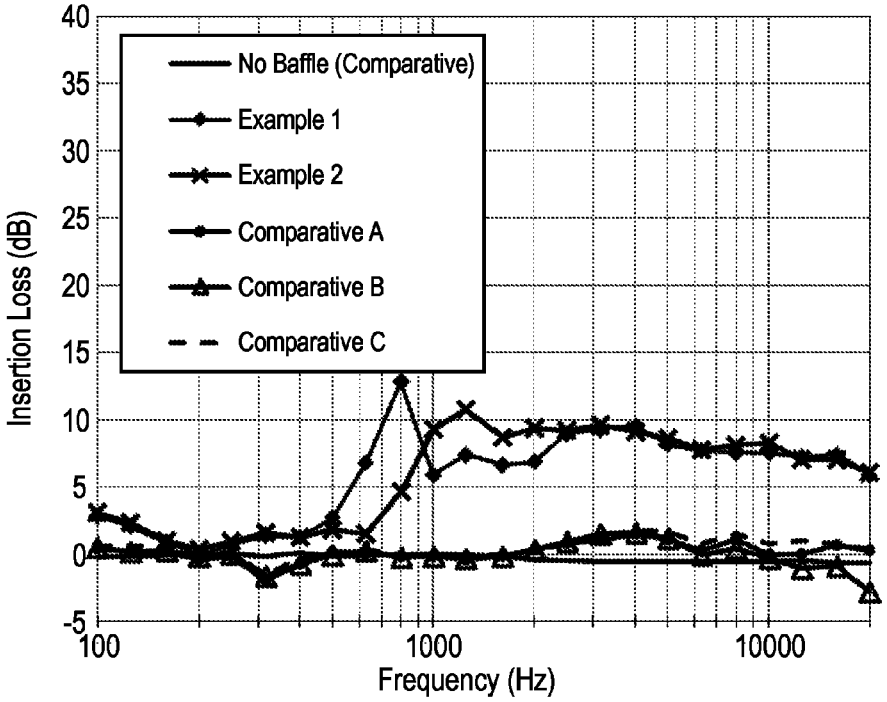
FIGS. 4-7 are graphs representing insertion loss values measured at ⅓ octave intervals across the frequency range 100-20 kHz, for exemplary baffle assemblies according to the present disclosure and comparative baffle assemblies, as described in the Examples herein.

The baffle assembly was installed in a wall cavity between a reverberation room and an anechoic room. The reverberation room was sound pressurized by a speakers providing balanced spectrum of "white noise" at approximately 104 dB SPL from 100-20 kHz. Sound attenuation (Insertion Loss) provided by the baffle assemblies were measured across a frequency range of 100 Hz to 20 kHz, at 1.5 meters from the baffle face, relative to the open wall cavity, according to the test procedure generally described in SAE J1400. Average Insertion Loss values are listed in Table 2. Insertion Loss values across the frequency range 100-20 kHz, measured at ⅓ octave intervals, are illustrated in FIGS. 4-7:

FIG. 4: No acoustic material

Figure 5:
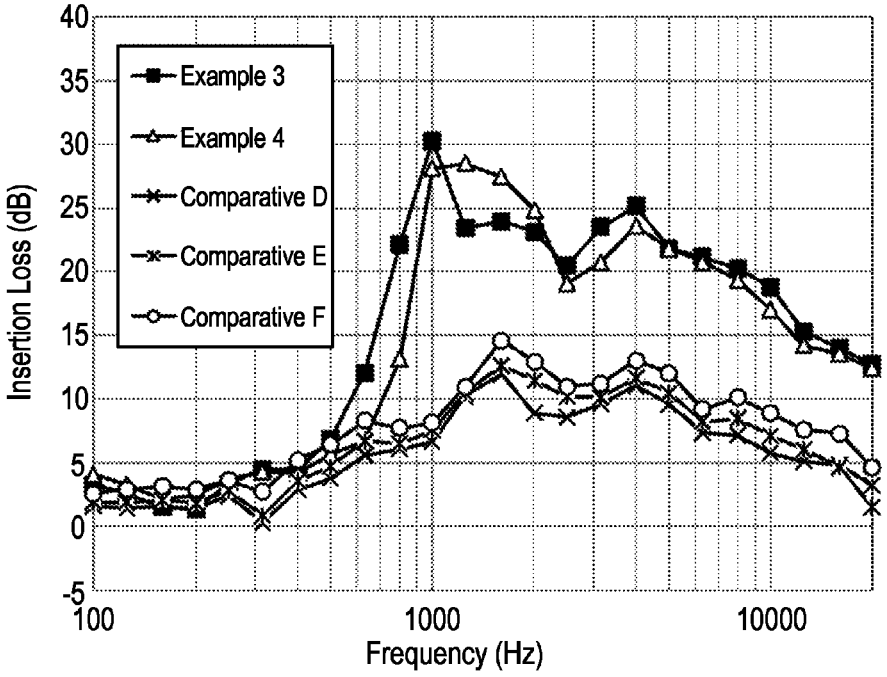

FIG. 5: Baffles covered with H-100SM

Figure 6:
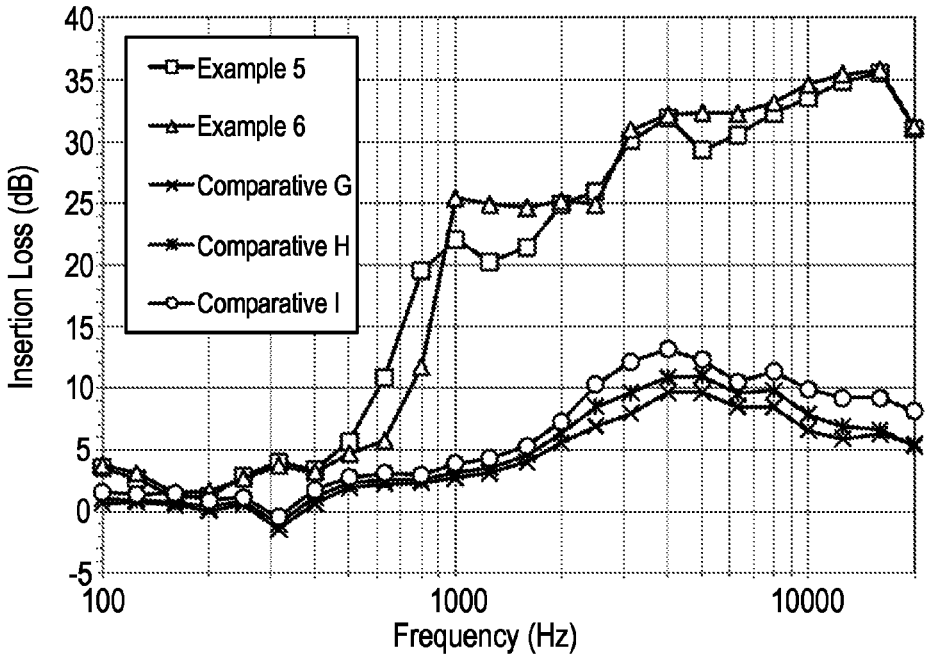

FIG. 6: Baffles covered with TC2303

Figure 7:
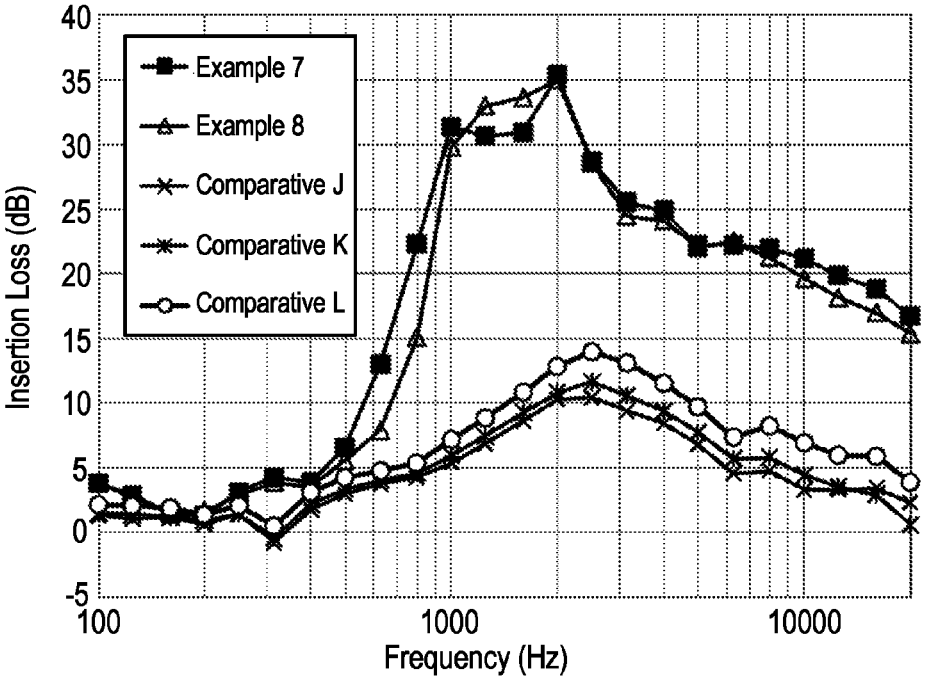

FIG. 7: Baffles covered with MA-4700

TABLE 2

| Sample | Baffle Assembly | Baffle Covering | Average Insertion Loss @ 1.5m SPL (dB) |
|---|---|---|---|
| Control | None | None | 15.5 |
| Example 1 | A | None | 21.1 |
| Example 2 | B | None | 21.1 |
| Example 3 | A | H-100PSM | 35.0 |
| Example 4 | B | H-100PSM | 35.0 |
| Example 5 | A | TC2303 | 43.2 |
| Example 6 | B | TC2303 | 42.5 |
| Example 7 | A | MA-4700 | 40.2 |
| Example 8 | B | MA-4700 | 39.9 |
| Comparative A | C1 | None | 17.7 |
| Comparative B | C2 | None | 16.2 |
| Comparative C | C3 | None | 16.7 |
| Comparative D | C1 | H-100PSM | 21.8 |
| Comparative E | C2 | H-100PSM | 22.3 |
| Comparative F | C3 | H-100PSM | 23.2 |
| Comparative G | C1 | TC2303 | 20.9 |
| Comparative H | C2 | TC2303 | 21.5 |
| Comparative I | C3 | TC2303 | 23.0 |
| Comparative J | C1 | MA-4700 | 19.9 |
| Comparative K | C2 | MA-4700 | 20.6 |
| Comparative L | C3 | MA-4700 | 22.6 |

Various modifications and alterations of this disclosure will become apparent to those skilled in the art without departing from the scope and principles of this disclosure, and it should be understood that this disclosure is not to be unduly limited to the illustrative embodiments set forth hereinabove.

I claim:

1. A baffle assembly for use in an inlet or exit of a duct, housing, enclosure or partition, comprising an S-shaped baffle section comprising two curved baffle units arranged so as to provide an S-shaped passage, wherein at least one curved baffle unit directly contacts an adjacent curved baffle unit and further wherein the one curved baffle unit and adjacent curved baffle unit have respective concave faces that are collinearly opposed.

2. The baffle assembly according to claim 1 comprising at least two S-shaped baffle sections each comprising two curved baffle units arranged so as to provide an S-shaped passage.

3. The baffle assembly according to claim 2 wherein at least two S-shaped baffle sections are arranged front-to-back in an "SS" configuration.

4. The baffle assembly according to claim 2 wherein at least two S-shaped baffle sections are arranged front-to-front in "SZ" configuration.

5. The baffle assembly according to claim 2 wherein at least two S-shaped baffle sections are arranged back-to-back in "ZS" configuration.

6. The baffle assembly according to claim 1 wherein the curved baffle units bear an acoustically absorbing material.

7. The baffle assembly according to claim 6 wherein the acoustically absorbing material is an acoustically absorbing non-woven material.

8. The baffle assembly according to claim 6 wherein the acoustically absorbing material is an acoustically absorbing foam material.

9. The baffle assembly according to claim 6 wherein the curved baffle units bear an acoustically absorbing material on their concave face.

10. The baffle assembly according to claim 6 wherein the curved baffle units bear an acoustically absorbing material on their concave face only.

11. The baffle assembly according to claim 1 wherein the curved baffle units include a curved portion and at least one flange portion.

12. The baffle assembly according to claim 11 wherein the curved portion has a cross-section selected from the group consisting of semi-circular, nearly semi-circular, parabolic, nearly parabolic, hyperbolic, and nearly hyperbolic.

13. The baffle assembly according to claim 1 wherein the curved baffle units have a shape capable of manufacture by a continuous extrusion process.

14. The baffle assembly according to claim 1 wherein the curved baffle units are made by a continuous extrusion process.

15. The baffle assembly according to claim 1 wherein the curved baffle units are constructed of polymer materials.

* * * * *